US005972132A

United States Patent [19]

Cadle

[11] Patent Number: 5,972,132

[45] Date of Patent: Oct. 26, 1999

[54] PROGRESSIVE DENSIFICATION OF POWDER METALLURGY CIRCULAR SURFACES

[75] Inventor: Terry M. Cadle, Wauwatosa, Wis.

[73] Assignee: Zenith Sintered Products, Inc., Germantown, Wis.

[21] Appl. No.: 09/247,348

[22] Filed: Feb. 10, 1999

Related U.S. Application Data

[60] Provisional application No. 60/074,391, Feb. 11, 1998.

[51] Int. Cl.[6] ..... B22F 3/24

[52] U.S. Cl. ..... 148/514; 72/208; 419/28

[58] Field of Search ..... 72/208; 148/514; 419/28

[56] References Cited

U.S. PATENT DOCUMENTS 3,867,751 2/1975 Connell et al. ..... 29/148.4 R
4,059,879 11/1977 Chmura ..... 29/148.4 R
4,774,749 10/1988 Furumura ..... 29/149.5 NM
4,818,301 4/1989 Khare ..... 148/11.5 N
5,453,242 9/1995 Knoess ..... 419/27
5,522,124 6/1996 Depperman ..... 29/90.01
5,540,883 7/1996 Jones et al. ..... 419/28
5,729,822 3/1998 Shivanath et al. ..... 428/551

*Primary Examiner*—Daniel J. Jenkins
*Attorney, Agent, or Firm*—Quarles & Brady

[57] ABSTRACT

Inner or outer cylindrical worked surfaces of powder metal components are bearingized by orbiting tapered rollers against them using a tapered mandrel having points for impacting the rollers against the worked surface.

10 Claims, 6 Drawing Sheets

FIG. 1A
PRIOR ART
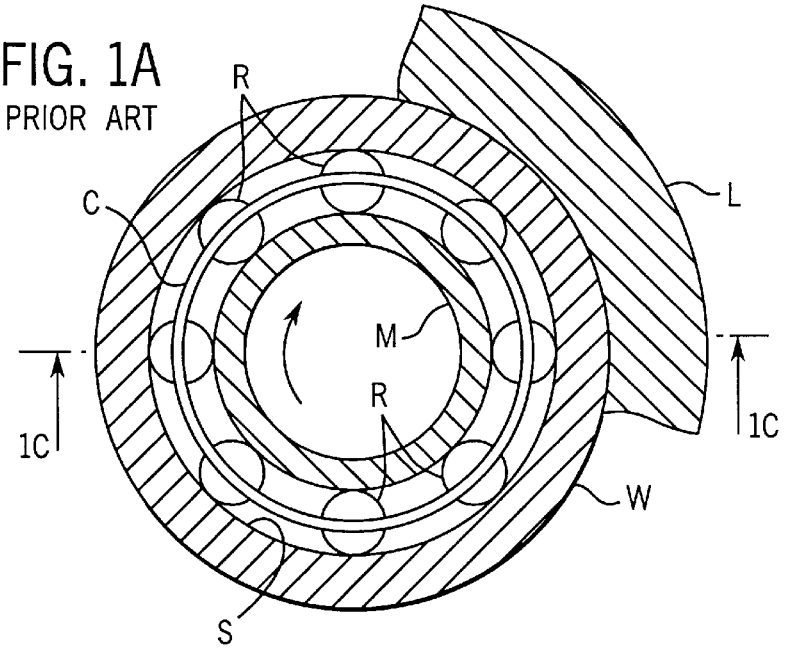
FIG. 1B
PRIOR ART
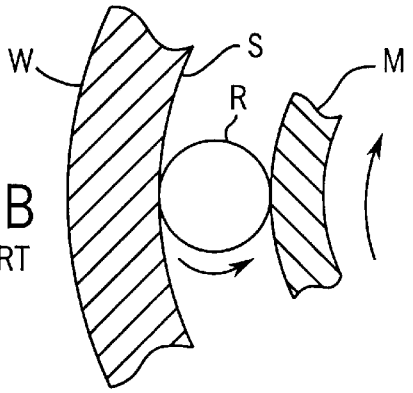
FIG. 1D
PRIOR ART
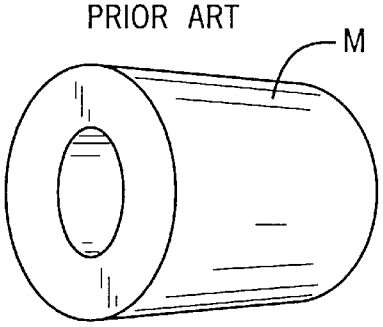
FIG. 1C
PRIOR ART
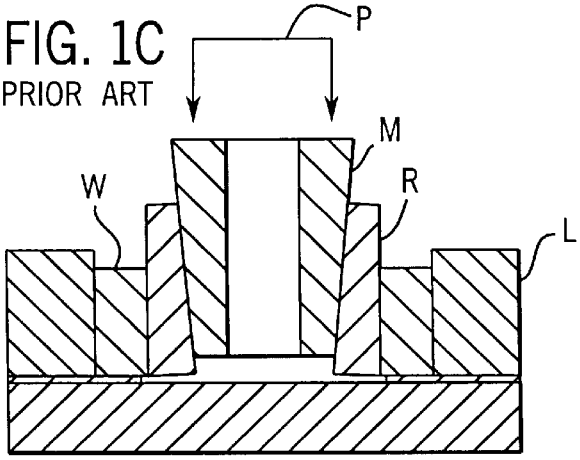
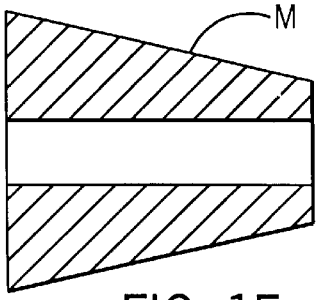
FIG. 1E
PRIOR ART

PROGRESSIVE DENSIFICATION OF POWDER METALLURGY CIRCULAR SURFACES

This claims the benefit of U.S. Provisional Patent Application Ser. No. 60/074,391 filed Feb. 11, 1998.

FIELD OF THE INVENTION

This invention relates to powder metallurgy metalworking processes, and in particular to a device and process for densifying the surface layer of the circular surface of a powder metallurgy product.

BACKGROUND OF THE INVENTION

There are many metalworking processes that improve the dimensional accuracy of a metal product. There are also processes that improve the smoothness of a metal surface. These methods include the traditional metal cutting techniques known as turning, milling, honing, and grinding for dimensional accuracy, and polishing, lapping, and burnishing for surface smoothness.

Of particular interest for both dimensional and smoothness quality is burnishing, and an extension of this technique called bearingizing. Most commonly, these two techniques are applied to cylindrical surfaces, such as the surfaces of a cylinder or tube.

Burnishing, in its most common form, uses many conical hard steel rollers to roll the product surface smooth. A typical form of a burnishing tool is schematically illustrated in FIGS. 1A–E for inner diameters and FIGS. 2A–E for outer diameters. Throughout the prior art figures, the following elements are labeled as follows: workpiece-W; worked surface-S; mandrel-M; mandrel force-P; rollers-R; roller cage-C; and support ring-L. Downward pressure is exerted on the mandrel M as indicated by the arrows P by any suitable means such as a spring or pneumatic or hydraulic pressure, as the mandrel M is rotated. The mating conical surfaces of the mandrel M and rollers R result in the rollers R being pressed against the worked surface S of the workpiece W (which is held stationary), resulting in densification and hardening of the surface S. The design is such that a burnishing tool will accommodate a substantial range of component diameters, for example a range of 0.040 inches (2 mm) in diameter of the surface S.

Bearingizing differs from burnishing in that it uses cylindrical rollers, and instead of only rolling the surface, the rollers also impact indent and thereby "peen" the surface. This is illustrated in FIGS. 3A–E and is accomplished with a parallel flat-sided mandrel M which is rotated inside of the roller cage C so that its points T (FIGS. 3A–E) impact the rollers R The rollers may be spring biased by the cage C against the outer surface of the mandrel M or not, but in any event are permitted sufficient radial movement by the cage C so as to impact the surface S when a point T passes by a roller R The result is that greater local pressure is applied to the metal surface S, and so the process is faster. It is also more accurate than burnishing. However, the bearingizing tools will only accommodate a diametral range of 0.004 inches (0.1 mm) and only applies a 0.002 inch (0.05 mm) change in diameter.

Recent developments in powder metallurgy require a different tool to achieve a different end result. In the case of powder metallurgy, great benefit in component functional properties can be gained by raising the density of the surface layer which rubs, rolls, or bounces against another component. In particular, bearing surfaces which must withstand rolling and rubbing stresses suffer from a failure mode called "rolling contact fatigue". This failure mechanism can be minimized by raising the surface layer density of a powder metallurgy bearing surface to near full density. In order to achieve this, a substantial amount of surface metal must be radially compressed. While this can be accomplished to some degree by roller burnishing, the hammering or peening action in bearingizing is more effective, and can produce a deeper layer of densification, which is beneficial in resisting higher surface stresses. It also can produce compressive residual stresses in the densified surface which further raises resistance to rolling contact fatigue.

The limited radial depth of movement of known bearingizing tools cannot accommodate this need. It would be necessary, for example, to use five separate bearingizing units to achieve a 0.010 inch (0.25 mm) diametral reduction. This is both very costly in equipment, and slow in process to the point of being impractical. What is needed for surface densification of powder metallurgy product, therefore, is a bearingizing tool with a practical range of diametral reduction.

SUMMARY OF THE INVENTION

This invention provides a design of a bearingizing tool which will achieve densification of a powder metallurgy circular surface, and also impart a smooth surface and precise dimensional quality of the type associated with conventional bearingizing tools. This is accomplished for inner or outer circular surfaces by orbiting tapered rollers against the worked surface using an axially tapered mandrel of a non-round shape, so as to impact the rollers against the worked surface. Since the mandrel is tapered, a relatively large diametral change is possible, making the invention especially suited for working powder metal surfaces.

The product which results from use of such a method and tool has a surface which is densified to full or near full density at a depth which is deeper than with a conventional bearingizing tool.

A surface working tool of the invention may be used to impact densify the inner cylindrical surface of a workpiece through a broader diametral range than prior bearingizing tools. In addition, the invention provides a bearingizing tool which may be used to impact density outer cylindrical surfaces through a similarly broad range.

These and other objects and advantages of the invention will be apparent from the detailed description and drawings.

BRIEF DESCRIPTION OF THE DRAWINGS

FIG. 1A is a top schematic partial sectional view of a prior art inside diameter burnishing tool;

FIG. 1B is a fragmentary schematic sectional view of a portion of the tool of FIG. 1A (cage and support ring not shown);

FIG. 1C is a sectional view from the plane of the line 1C—1C of FIG. 1A;

FIG. 1D is a perspective view of a mandrel for the tool of FIG. 1A;

FIG. 1E is a sectional view of the mandrel of FIG. 1D;

Detailed Description of the Preferred Embodiments

Figure 2A:
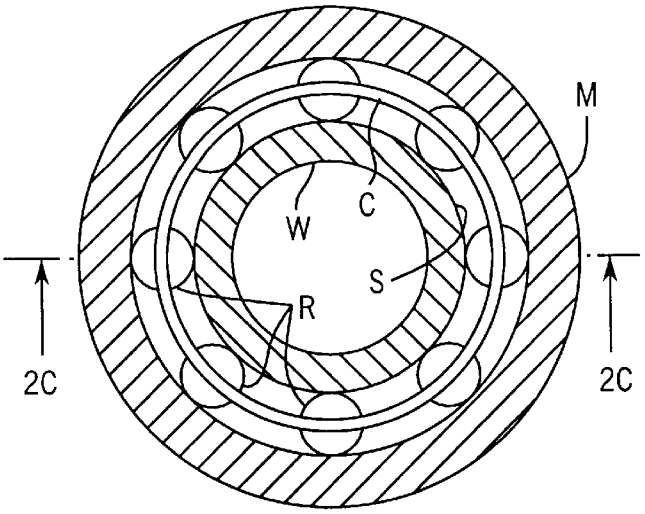
FIG. 2A PRIOR ART
FIG. 2A is a top schematic partial sectional view of a prior art outside diameter burnishing tool.
Figure 2B:
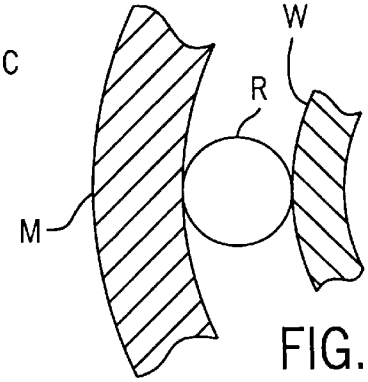
FIG. 2B PRIOR ART
FIG. 2B is a fragmentary schematic sectional view of a portion of the tool of FIG. 2A (cage not shown)
Figure 2C:
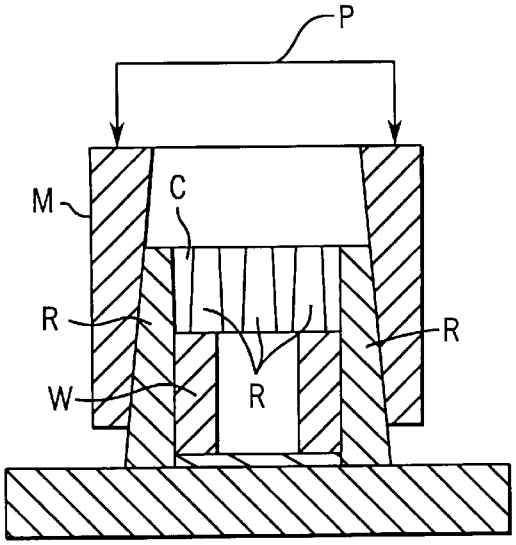
FIG. 2C PRIOR ART
FIG. 2C is a sectional view from the plane of the line 2C—2C of FIG. 2A.
Figure 2D:
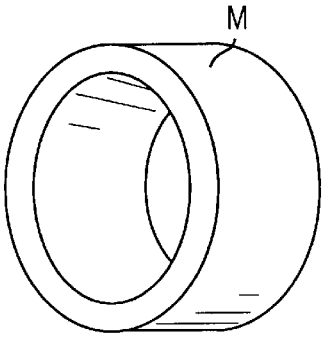
FIG. 2D PRIOR ART
FIG. 2D is a perspective view of a mandrel for the tool of FIG. 2A.
Figure 2E:
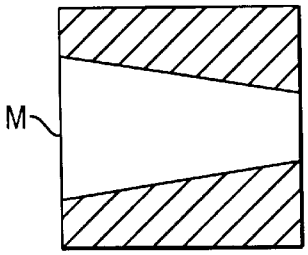
FIG. 2E PRIOR ART
FIG. 2E is a sectional view of the mandrel of FIG. 2D.
Figure 3A:
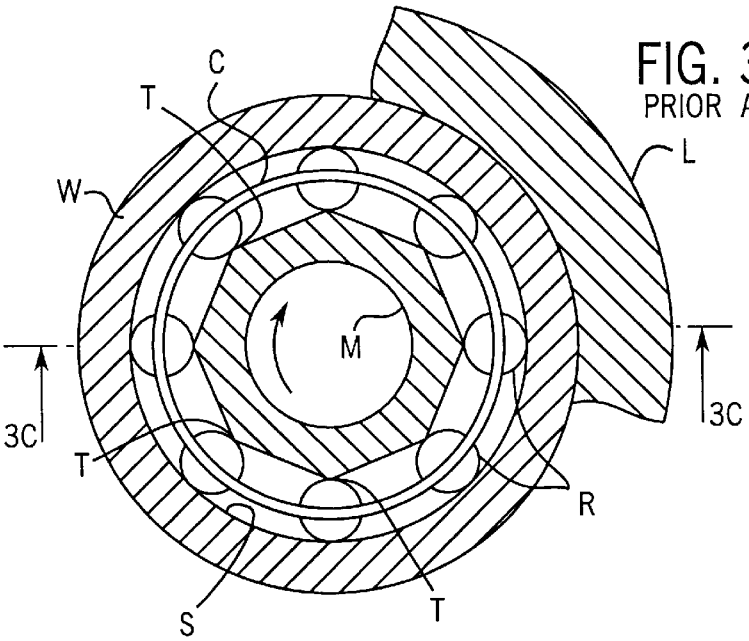
FIG. 3A PRIOR ART
FIG. 3A is a top schematic partial sectional view of a prior art inside diameter bearingizing tool.
Figure 3B:
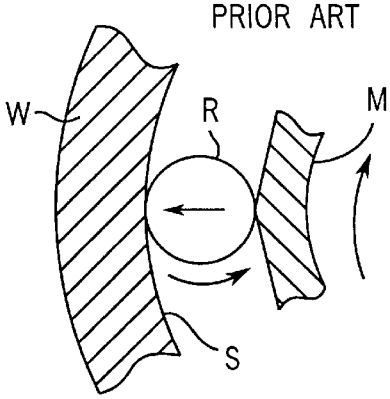
FIG. 3B PRIOR ART
FIG. 3B is a fragmentary schematic sectional view of a portion of the tool of FIG. 3A (cage and support ring not shown)
Figure 3C:
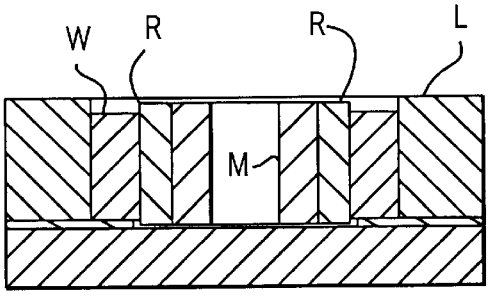
FIG. 3C PRIOR ART
FIG. 3C is a sectional view from the plane of the line 3C—3C of FIG. 3A.
Figure 3D:
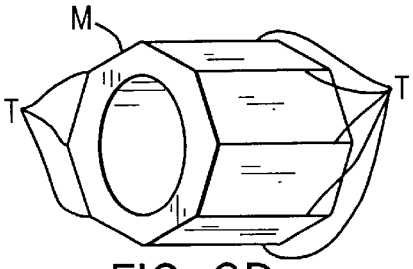
FIG. 3D PRIOR ART
FIG. 3D is a perspective view of a mandrel for the tool of FIG. 3A.
Figure 3E:
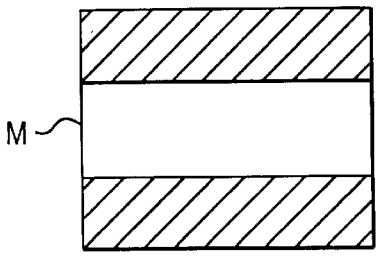
FIG. 3E PRIOR ART
FIG. 3E is a sectional view of the mandrel of FIG. 3D.

The design of the working end of a surface working tool 10 of the invention is partially shown in FIG. 4, where the inner diameter of a powder metallurgy product 12 is to be densified. The conical rollers 20 float freely in the bearing cage 22 so that, at least to a certain extent, they roll across the flats 14 on the tapered mandrel 16 as the mandrel 16 is rotated, and then, as they roll over the points 18, they are forced radially outwards. Since all rollers 20 experience this outward radial motion simultaneously, the rollers 20 indent the inner diameter of the powder metal cylinder 12. With rapid rotation of the tapered mandrel 16, it is possible to cause up to 200,000 impacts per minute, depending on the speed of rotation and number of rollers, although lower impact rates are also possible. Thereby, the desired densification is produced, provided the rollers 20 are forced outwards to keep up with the expanding powder metal surface being densified. A backing or support ring 24 is preferably provided, which closely surrounds the workpiece 12, so as to provide support to the workpiece 12 against the hammering of its inner surface 21.

Figure 4A:
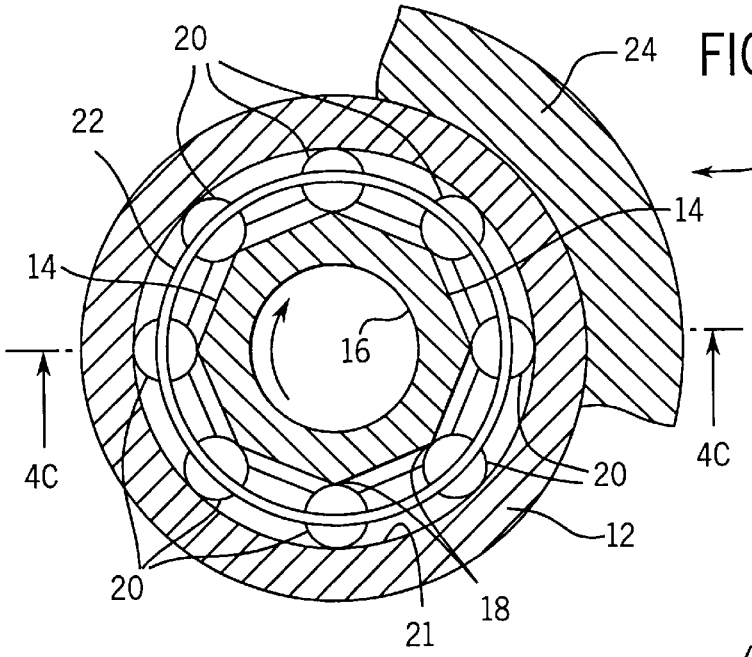
FIG. 4A is a top schematic partial sectional view of an inside diameter bearingizing tool of the invention.
Figure 4B:
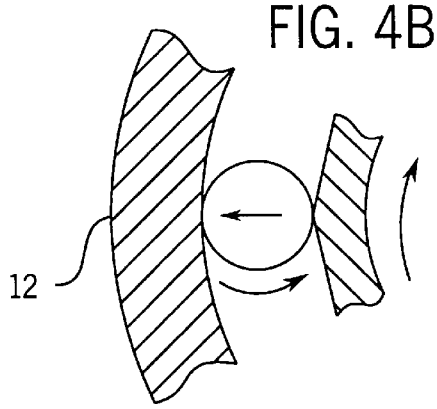
FIG. 4B is a fragmentary schematic sectional view of a portion of the tool of FIG. 4A (cage and support ring not shown)
Figure 4C:
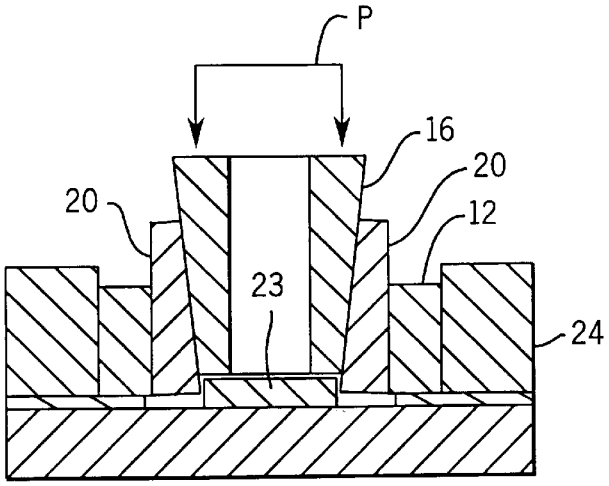
FIG. 4C is a sectional view from the plane of the line 4C—4C of FIG. 4A.
Figure 4E:
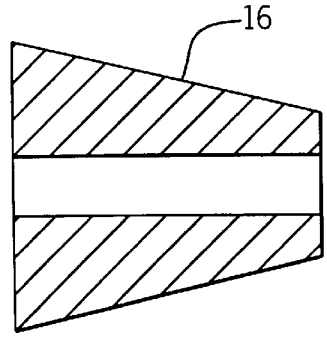
FIG. 4E is a sectional view of the mandrel of FIG. 4D.
Figure 4D:
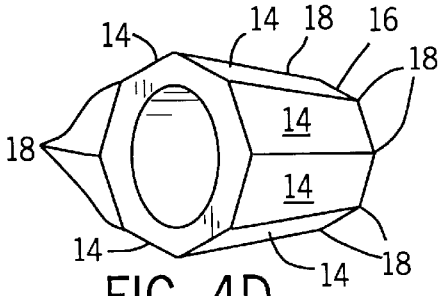
FIG. 4D is a perspective view of the frusto-conical mandrel for the tool of FIG. 4A.

In addition, a stop can be provided, either by building a stop into the pressure applying device, for example a screw type stop, or providing a spacer, for example in the space beneath the mandrel 16 in FIG. 4C as indicated by the stop 23, to limit the axial motion of the mandrel 16 as it is pressed into the rollers 20 as the rollers roll (at least part way) over the flats 14. Such a stop can be used to adjust the magnitude of the impacts, and can be changed periodically throughout a densifying operation of a workpiece to progressively permit insertion of the mandrel 14 so as to obtain the full diameter change sought. Depending on the application and the level of densification sought, a stop may or may not be desirable.

Thus, the invention may be practiced by placing the rollers in the workpiece while holding the workpiece against rotation. The mandrel is then turned on, brought up to speed and inserted axially into the set of rollers. When the comers or points of the mandrel start to impact the rollers, the rollers start rotating and orbiting around the worked surface. If during insertion the resistance to further insertion becomes too great, further insertion may be stopped, or paused, until the resistance to further axial insertion subsides, indicating a diametral change (increase) due to the peening action of the rollers. Insertion then may be continued until the desired diameter is obtained, or the limit of insertion, as set by a stop such as 23, is reached.

Figure 5:
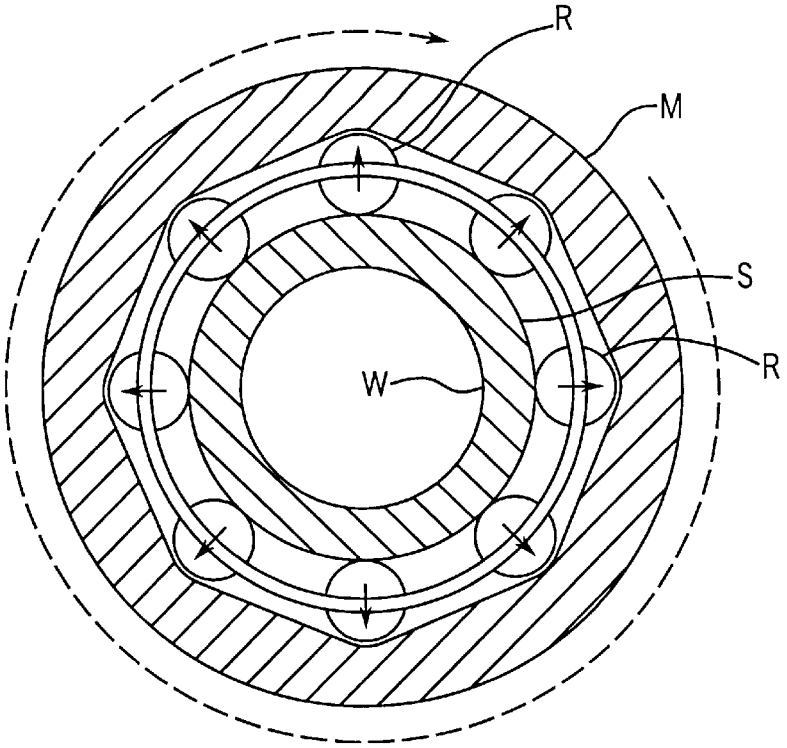
FIG. 5 is a top schematic view illustrating why a prior art type external surface bearingizing tool does not work.

Another aspect of this invention is the ability to density the outer diameter of a cylindrical powder metallurgy product by impact bearingizing. External diameter bearingizing is not currently practiced. This is due to the fact that a spinning bearingizing tool, based on current technology, (shown in FIG. 5) would be ineffective. The densifying rollers would simply fly outwards under centrifugal forces and rest in the recesses of the outer cage. The rollers would therefore not be able to engage the surface to be processed.

This invention provides an alternative approach which involves a progressive bearingizing tool to density the outer diameter of cylindrical powder metallurgy products. The design of such a tool is shown in FIGS. 6A–E, in which the same reference numbers as used in FIGS. 4A–E are used to designate corresponding elements, plus 100. A support plug (not shown) may be needed when densifying the outer surface depending on the radial wall thickness of the workpiece. The pressure P is applied to the mandrel 116.

The tool 110 does not suffer from the centrifugal loss of contact problem because, as the rollers fly outwards, the tapered mandrel feeds downward over the correspondingly tapered rollers, which pushes the rollers inwards to recontact the powder metallurgy surface being densified. This progressive action is achieved by applying steady downward pressure on the mandrel by well-known methods, such as springs, pneumatic or hydraulic pressure, and this pressure may be limited in axial travel by a suitable ring stop 123.

Figure 7:
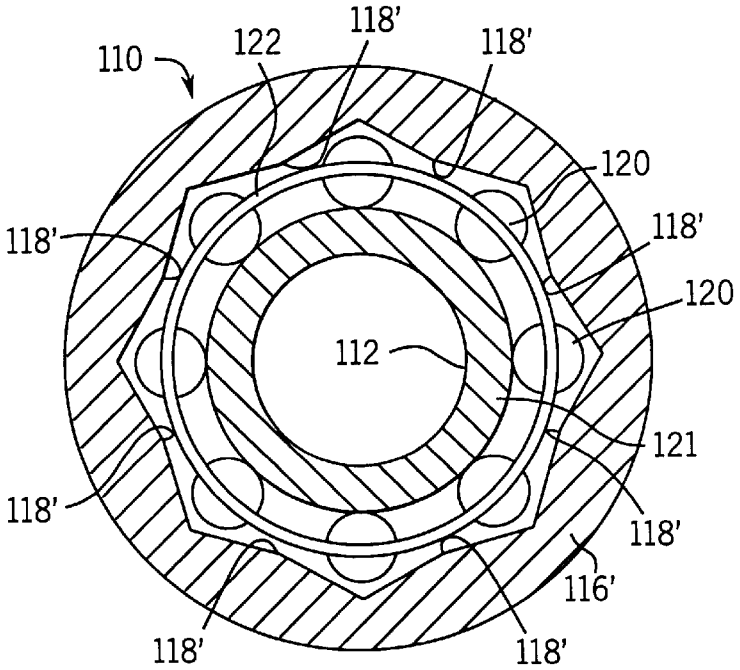
FIG. 7 is a view similar to FIG. 6A but illustrating an alternate mandrel.
Figure 6A:
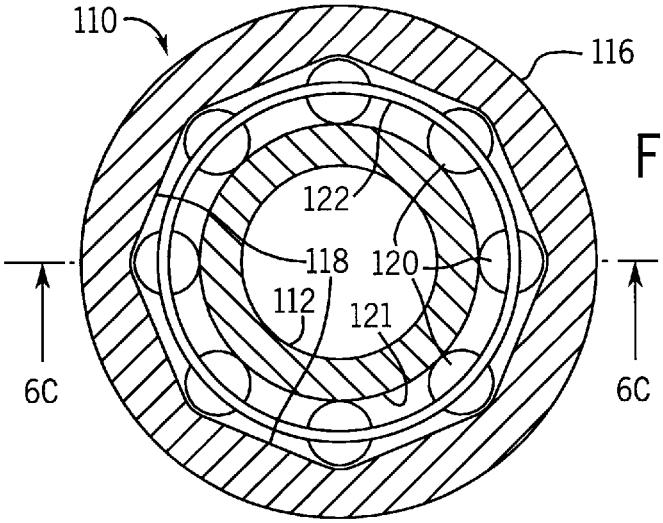
FIG. 6A is a top schematic view of an outside diameter bearingizing tool of the invention.
Figure 6B:
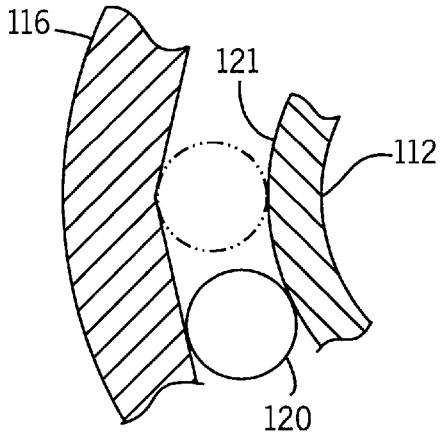
FIG. 6B is a fragmentary schematic sectional view of a portion of the tool of FIG. 6A (cage not shown)
Figure 6C:
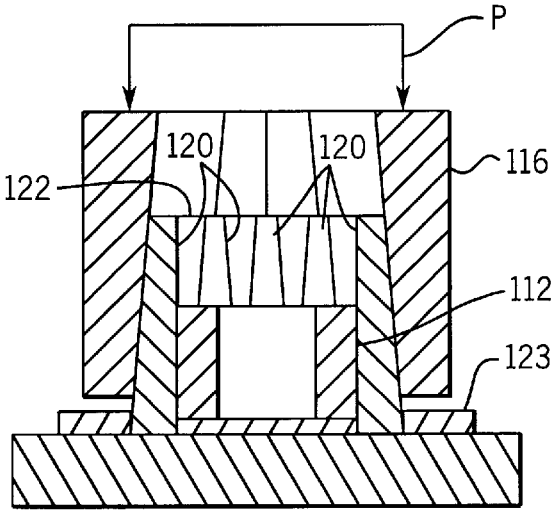
FIG. 6C is a sectional view from the plane of the line 6C—6C of FIG. 6A.
Figure 6D:
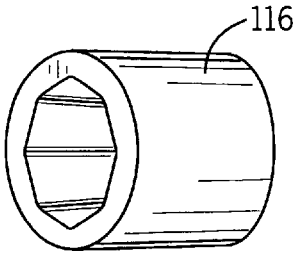
FIG. 6D is a perspective view of a mandrel for the tool of FIG. 6A.
Figure 6E:
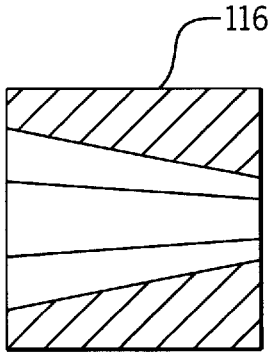
FIG. 6E is a sectional view of the mandrel of FIG. 6D.

In the tool 110 as illustrated in FIGS. 6A–E, the "points" 118 are actually at the middle of each internal flat, where the inside diameter is a minimum. The roller shown in phantom in FIG. 6B is at a valley, where it would be either pressing with reduced force or out of contact (if a stop is provided) with the worked surface 121. The pressing force of the roller 120 against the worked surface 121 increases as the roller 120 moves toward the center of the flat, as shown by the roller 120 illustrated in full in FIG. 6B. As an alternative, the mandrel 116' of FIG. 7 may be used, in which the points 118' (corresponding to the centers of the flats of the mandrel 116) are actually shaped like points or peaks.

Thus the invention provides a mechanical tool which is designed to progressively densify and improve the surface finish of a powder metallurgy product by high frequency roller impacts, to provide a surface densified product. The invention provides this by utilizing a mandrel with a non-round tapered working surface, preferably a surface defined by a polygon in radial cross-section. By this means, the invention is adaptable to work inner and outer cylindrical surfaces of a powder metallurgy product.

Preferred embodiments of the invention have been described in considerable detail. Many modifications and variations to the embodiments described will be apparent to those skilled in the art. Therefore, the invention should not be limited to the embodiments described, but should be defined by the claims which follow.

I claim:

1. A progressive bearingizing tool for densifying a circular worked surface of a sintered metal workpiece, comprising:

a set of rollers for rolling along said worked surface, said rollers being tapered in length so as to each be frusto-conical in shape with each having a small diameter end and an opposite large diameter end, each roller of said set being oriented the same as each other roller of said set so as to roll around said worked surface as said set is rotated about an axis of said worked surface;

a mandrel on an opposite radial side of said set of rollers from said worked surface, said mandrel having a surface which is non-round in radial cross-sectional shape and tapered in axial cross-sectional shape so as to contact said rollers on said opposite radial side from the small diameter ends of said rollers and for a distance along the length of said rollers toward said large diameter ends when said mandrel is rotated, said mandrel being tapered in axial cross-sectional shape so as to urge said rollers into more forceful contact with said worked surface as said mandrel is pressed into a longer length of contact with said rollers and said non-round shape of said mandrel surface being such as to impact said rollers against said worked surface when said mandrel is rotated about said axis of said worked surface.

2. A progressive bearingizing tool as claimed in claim 1, wherein said worked surface is an outer circular surface.

3. A progressive bearingizing tool as claimed in claim 2, wherein said worked surface is cylindrical.

4. A progressive bearingizing tool as claimed in claim 1, wherein said worked surface is an inner circular surface.

5. A progressive bearingizing tool as claimed in claim 4, wherein said worked surface is cylindrical.

6. A progressive bearingizing tool as claimed in claim 1, wherein said non-round shape of said mandrel surface is a polygon.

7. A progressive bearingizing tool as claimed in claim 1, wherein said mandrel exerts a cyclically varying force on each of said rollers so as to vary the force exerted by each said roller on said worked surface.

8. A method of densifying a circular worked surface of a sintered powder metal workpiece comprising the steps of:

providing a set of rollers for rolling along said worked surface, said rollers being tapered in length so as to each be frusto-conical in shape with each having a small diameter end and an opposite large diameter end, each roller of said set being oriented the same as each other roller of said set so as to roll around said worked surface as said set is rotated about an axis of said worked surface;

providing a mandrel on an opposite radial side of said set of rollers from said worked surface, said mandrel having a surface which is non-round in radial cross-sectional shape and tapered in axial cross-sectional shape so as to contact said rollers on said opposite radial side from the small diameter ends of said rollers and for a distance along the length of said rollers toward said large diameter ends when said mandrel is rotated, said mandrel being tapered in axial cross-sectional shape so as to urge said rollers into more forceful contact with said worked surface as said mandrel is pressed into a longer length of contact with said rollers and said non-round shape of said mandrel surface being such as to impact said rollers against said worked surface when said mandrel is rotated about said axis of said worked surface;

rotating said mandrel so as to engage said rollers in rotation and orbiting around the axis of said worked surface.

9. A method as claimed in claim 8, wherein said mandrel exerts a cyclically varying force on each of said rollers so as to vary the force exerted by each said roller on said worked surface.

10. A sintered powder metal workpiece having a worked surface densified by the method of claim 8.

* * * * *